US005823006A

United States Patent [19]

Jung

[11] Patent Number: 5,823,006

[45] Date of Patent: Oct. 20, 1998

[54] AIR CONDITIONER AND CONTROL APPARATUS THEREOF

[75] Inventor: Nack-Hun Jung, Suwon, Rep. of Korea

[73] Assignee: Samsung Electronics Co., Ltd., Suwon, Rep. of Korea

[21] Appl. No.: 621,640

[22] Filed: Mar. 26, 1996

[30] Foreign Application Priority Data

Mar. 30, 1995 [KR] Rep. of Korea ..... 1995-6081

[51] Int. Cl.[6] ..... F25B 9/00; F25B 13/00

[52] U.S. Cl. ..... 62/291; 62/90; 62/324.6

[58] Field of Search ..... 62/160, 90, 324.6

[56] References Cited

U.S. PATENT DOCUMENTS 2,932,178 4/1960 Armstrong et al. ..... 62/90 X
5,355,690 10/1994 Iritani et al. ..... 62/90
5,390,508 2/1995 Benedict ..... 62/324.6

FOREIGN PATENT DOCUMENTS

4/288483 10/1992 Japan .

*Primary Examiner*—William E. Wayner
*Attorney, Agent, or Firm*—Burns, Doane, Swecker & Mathis, L.L.P.

[57] ABSTRACT

An air conditioning system for heating and cooling a room includes an indoor heat exchanger unit which has a housing and two separate heat exchangers disposed therein. Those two heat exchangers have different heat transmission areas and are connected by refrigerant pipes to respective outdoor heat exchangers. Valving is provided which enables either or both of the indoor heat exchangers to function as evaporators during a cooling mode, or to function as condensers during a heating mode. In other operating modes, either of the indoor heat exchangers functions as an evaporator while the other indoor heat exchanger simultaneously functions as a condenser to heat and humidify the room.

13 Claims, 15 Drawing Sheets

AIR CONDITIONER AND CONTROL APPARATUS THEREOF

BACKGROUND OF THE INVENTION

1. Field of the Invention

The present invention relates to an air conditioner, and more particularly to an air conditioner and a control apparatus thereof for effectively controlling cooling temperature, heating temperature and humidity in a room by way of a plurality of indoor heat exchangers disposed in an indoor unit.

2. Description of the Prior Art

Generally, an indoor unit and an outdoor unit of the air conditioner are operated in one system, and a cooling operation or a heating operation is performed according to the need thereof.

In the cooling operation of an air conditioner employing an indoor unit 1 and an outdoor unit 3 according to the prior art, refrigerant gas of high pressure and high temperature discharged out of a compressor 5 is, as illustrated in FIG. 1, cooled and liquefied in an outdoor heat exchanger 7 to thereafter be heat-exchanged with room air, and the liquefied refrigerant of high pressure is in turn infused into a capillary tube 9.

As a result, the refrigerant liquid of high pressure is converted into the liquid of low pressure by adiabetic expansion effect to thereby be infused into an indoor heat exchanger 11.

At this time, the refrigerant liquid of low pressure is evaporated in the indoor heat changer 11 and heat-exchangewr with the room air, thereby cooling a room.

The refrigerant liquid of low pressure is converted to refrigerant gas in the indoor heat exchanger 11 to thereafter by introduced into the compressor 5.

Thereafter, the refrigerant gas is converted to refrigerant gas of high pressure and high temperature to thereafter repeat a cooling cycle thus described.

A heating operation of an air conditioner is done in a reverse way from the cooling operation thereof, whereby the refrigerant circulates in a reverse direction to thereby heat the room.

In other words, the refrigerant gas is condensed in the indoor heat exchanger 11 and heat-exchanged with the room air to thereby heat the room.

The indoor unit of an air conditioner according to the prior art having a refrigerant cycle thus described is disposed, as illustrated in FIG. 2, with a front panel 13 at a front side of a body 10. The front panel 13 is formed at an upper surface thereof with a suction inlet 15 so as to allow the room air to be sucked into the body 10 and is also provided thereunder a discharge outlet 17 so as to allow the air heat-exchanged in the body 10 to be discharged again into the room.

A duct 19 is arranged between the suction inlet 15 and the discharge outlet 17 in order to guide the flow of the air. The suction inlet 15 is assembled at a rear surface thereof as a releasable fitting to an air filter 21 so as to filter the dust and the like contained in the air sucked into the body 10.

The air filter 21 is disposed at a rear side thereof with the indoor heat exchanger 11 with refrigerant flowing therein in order to heat-exchange the room air sucked through the suction inlet 15.

Furthermore, the indoor heat exchanger 11 is so arranged thereunder with a condensed water pad 23 that water generated and then condused by contact with the moisture contained in the room air can be temporarily stored therein and then discharged externally.

The body 10 is provided therein with an indoor fan 25 for generating a circulating power against the air, so that the room air can be infused into the body 10, cooled by the indoor heat exchanger 11 and discharged into the room again.

The discharge outlet 17 is disposed with a plurality of wind direction up/down control blades 27 and wind direction left/right control blades 29 so that discharge directions of the air discharged into the room can be adjusted in every direction.

In the indoor unit of an air conditioner structured as above, when operation means (not shown) is manipulated to operate the indoor unit 1 for cooling operation, as indoor fan 25 is rotated by activation of a motor (not shown), and simultaneously refrigerant flows via a refrigerant loop in the indoor heat exchanger 11, which is illustrated in FIG. 1.

At this time, a pressure difference of air occurs between a lower area in the body 10 and an external area of the body 10 due to rotation of the indoor fan 25, and the room air is infused into an upper portion in the body 10 through the suction inlet 15 by the pressure difference of the air, thereafter passing around the indoor heat exchsanger 11 and being heat-exchanged with the refrigerant flowing in the indoor heat exchanger 11.

The heat-exchanged refrigerant is guided by a duct 19 to pass by the indoor fan 25 and to be discharged indoors through the discharge outlet 17 for an indoor cooling.

At this location, the discharged directions of the air discharged into the room is adjusted up and down, and left and right by the plurality of wind direction up/down control blades 27 and wind direction left/right control blades 29 arranged at the discharge outlet 17.

However, there is a problem in the conventional indoor unit of an air conditioner constructed as above, in that one indoor heat exchanger installed thereon for performing both the cooling and heating operations cannot cope with sudden changes of outdoor temperatures in an appropriate manner and it is not easy to perform fine temperature and humidity controls.

In particular, the conventional indoor unit of an air conditioner cannot fully satify a need for fine temperature and humidity controls in hospitals, play rooms of children or in time of sleeping or in a change of seasons.

In other words, due to such a construction where only one heat exchanger is disposed at an indoor unit of an air conditioner according to the prior art, it is impossible to achieve fins indoor temperature and humidity controls because only one function of the heat exchanger has to be selectively chosen for operation, wherely the heat exchanger can be operated only either as an evaporator for lowering the temperature of the room air or as a condenser for raising the temperature of the room air.

Japanese Patent Laid-open Publication No. Hei 4-288483 discloses a heat exchanger of an air conditioner, where, as illustrated in FIG. 3, an opening unit 101 is formed between an upper heat exchanger 102 and a lower heat exchanger 103 such that the condensed water is not stored but is caused to smoothly flow down toward a lower fin, thereby improving a heat exchange efficiency.

However, there is a problem in that the said Japanese air conditioner is also disposed only one indoor heat exchanger such that sudden external temperature changes cannot be adequately coped with, and the cooling or heating operation should be selectively chosen by the only heat exchanger.

SUMMARY OF THE INVENTION

Accordingly, the present invention is disclosed to solve the aforemention problems and it is an object of the present invention to provide an air conditioner and a control apparatus thereof for employing a plurality of independently-operating indoor heat exchangers within an indoor unit to effectively control humidity and cooling and heating temperatures in a room.

In accordance with one aspect of the present invention, there is provided an air conditioner, the air conditioner comprising:

a suction inlet for sucking room air into a body;

a filter for filtering dust contained in the sucked room air;

an indoor heat exchanger for heat-exchanging the room air sucked into the body; and an indoor fan for discharging indoors the air heat-exchanged by the indoor heat exchanger through a discharge outlet;

wherein the indoor heat exchanger is disposed in the body in plurality so as to be operated as separate evaporators respectively.

In accordance with another aspect of the present invention, there is provided a control apparatus of an air conditioner, the apparatus comprising:

operation manipulating means for inputting operating conditions of the air conditioner;

control means for controlling the cooling and heating operations by way of one indoor unit for controlling a plurality of heat exchangers according to the operating conditions input by the operation manipulating means;

compressor driving means for driving a compressor to perform the cooling and heating operations according to control of the control means;

four-way valve driving means for receiving a control signal output from the control means according to the operating conditions input by the operation manipulating means to controllably drive a four-way valve so that a passage for the refrigerant to circulate therein can be changed; and solenoid valve driving means for receiving the control signal output from the control means according to the operating conditions input by the operation manipulating means to controllably drive a solenoid valve so that the passage for the refrigerant to circulate therein can be closed and opened.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
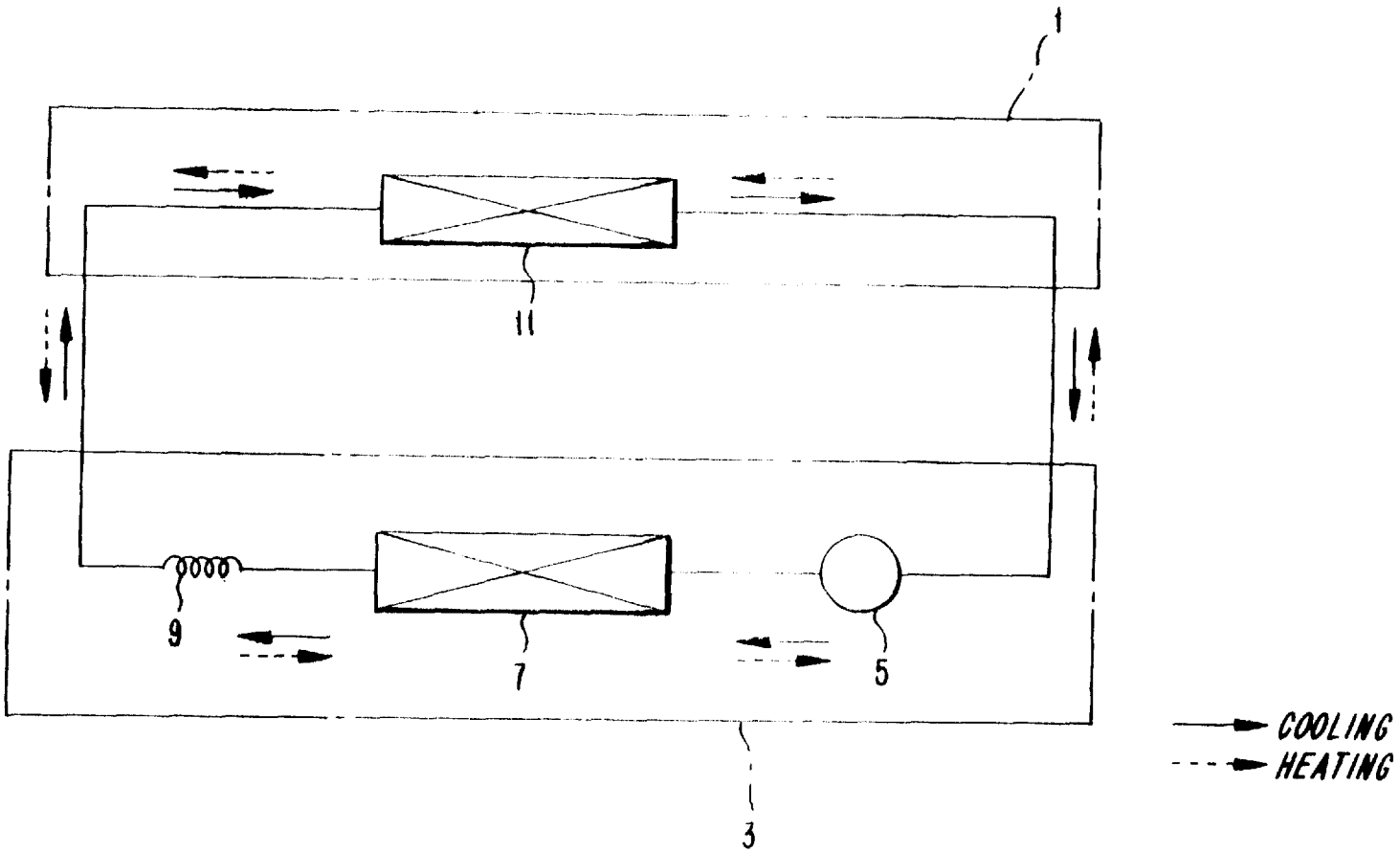
FIG. 1 (PRIOR ART)
FIG. 1 is a schematic diagram for illustrating a refrigerant cycle of an air conditioner according to the prior art.
Figure 2:
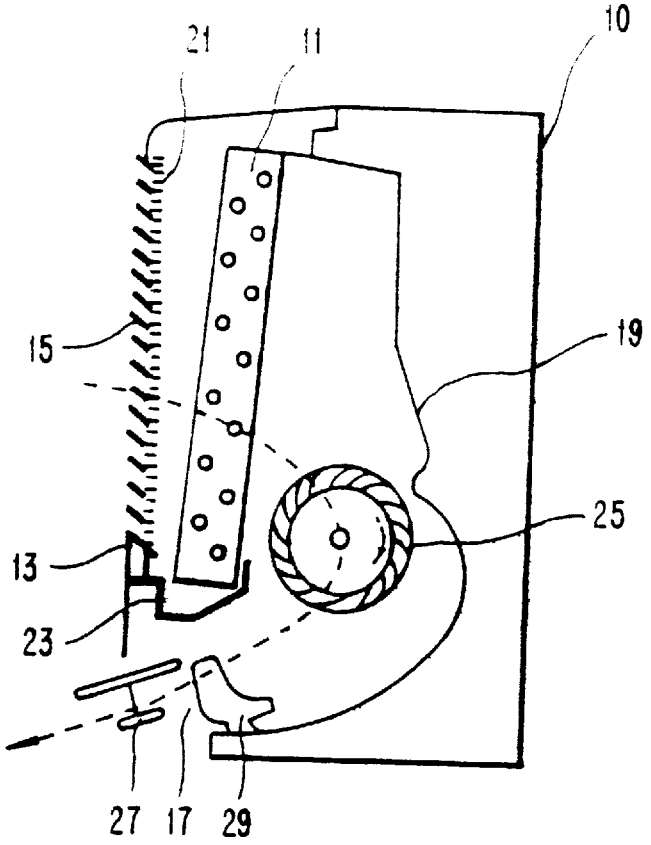
FIG. 2 (PRIOR ART)
FIG. 2 is a longitudinal sectional view for illustrating an indoor unit of an air conditioner according to the prior art.
Figure 3:
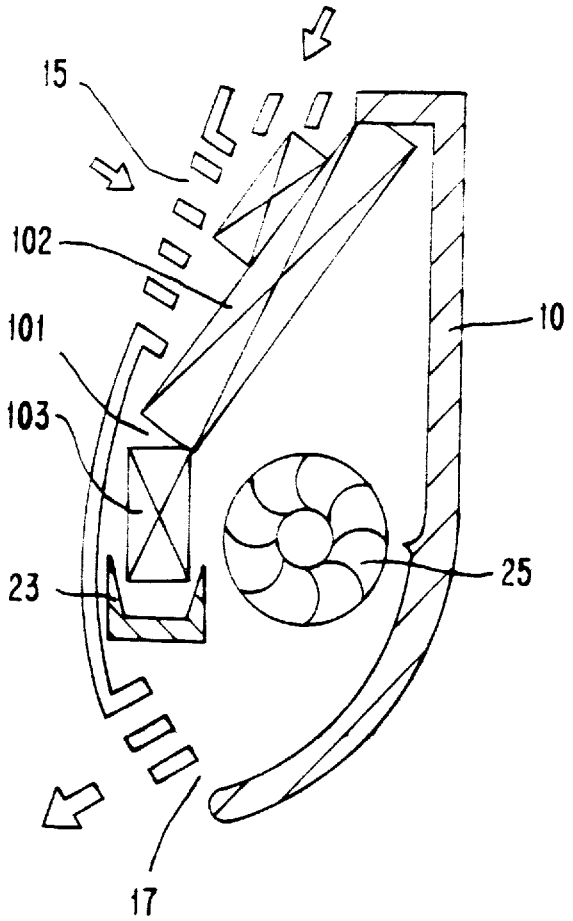
FIG. 3 (PRIOR ART)
FIG. 3 is a longitudinal sectional view for illustrating an air conditioner employing a heat exchanger according to the prior art.

Now, the embodiment of the present invention will be described in detail with reference to the accompanying drawings. Throughout the drawings, like reference numerals as in FIGS. 2 and 3 are used for designation of like or equivalent parts or portions for simplicity of illustration and explanation. Redundent description is omitted.

Figure 4:
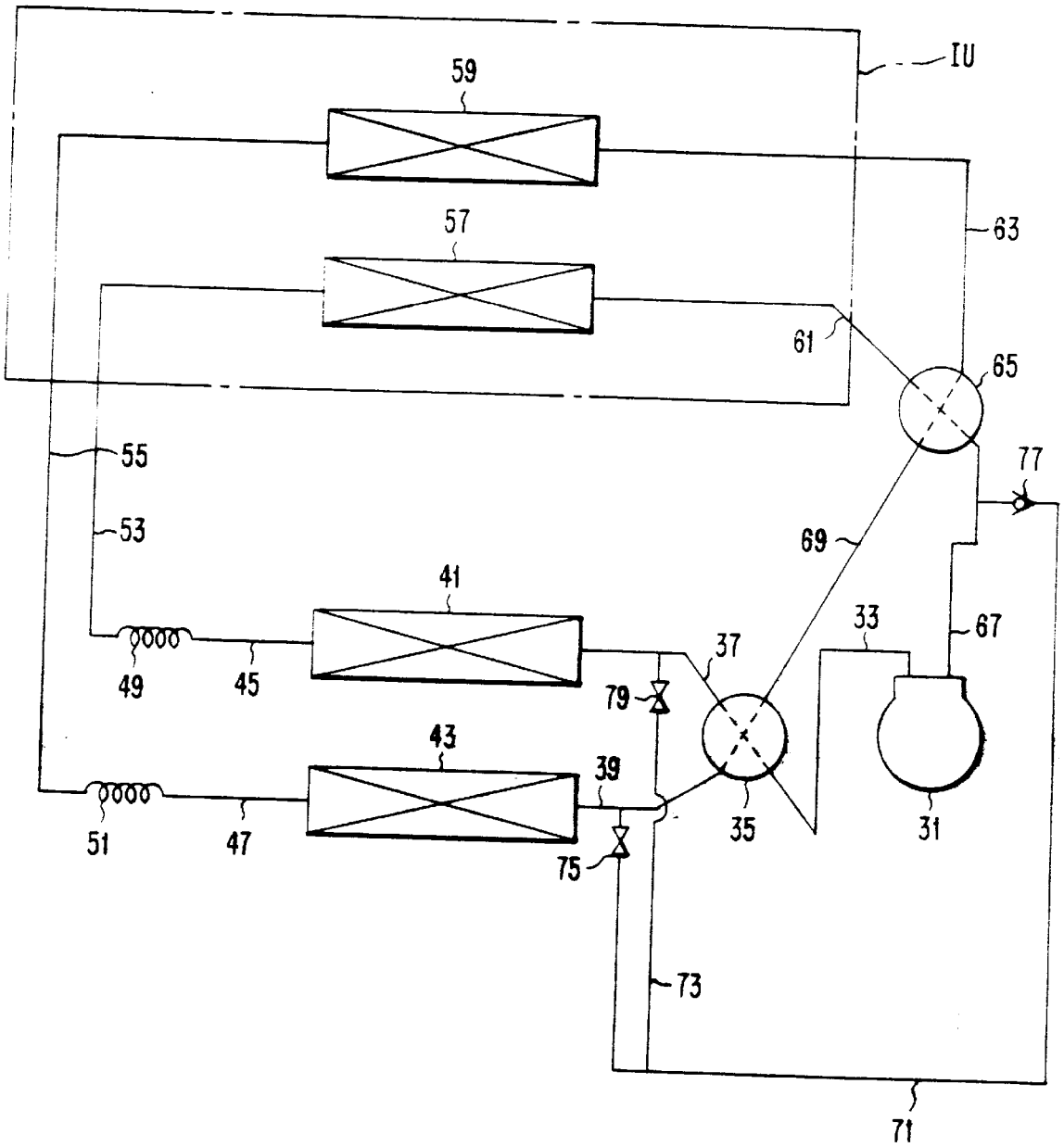
FIG. 4 is a schematic diagram for illustrating a refrigerant cycle of an air conditioner according to an embodiment of the present invention.
Figure 5:
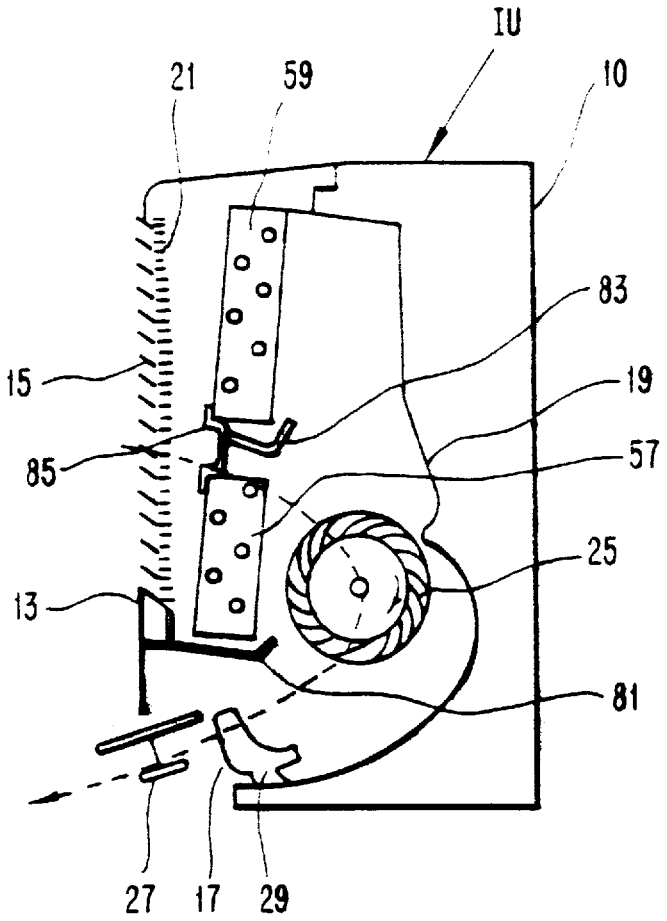
FIG. 5 is a longitudinal sectional view for illustrating an indoor unit of an air conditioner according to the embodiment of the present invention.

As illustrated in FIG. 4, the air conditioner according to the embodiment of the present invention is formed by two lines of refrigerant cycles by one compressor 31.

In other words, the compressor 31 is connected at one end thereof to one end of a discharge pipe 33 in order to guide refrigerant gas of high pressure and high temperature discharged from the compressor 31.

The discharge pipe 33 is disposed at the other end thereof with a first four-way valve 35 in order to change flow direction of the refrigerant gas.

The first four-way valve 35 is arranged with a first and a second outdoor heat exchangers 41 and 43 through the medium of respective refrigerant tubes 37 and 39 in order to heat-exchange the refrigerant with the outdoor air.

The first and second outdoor heat exchangers 41 and 43 are respectively disposed at one end thereof with a first and a second capillary tubes 49 and 51 for converting the refrigerant liquid of high pressure to that of low pressure through the media of refrigerant tubes 45 and 47.

The first and second capillary tubes 49 and 51 are respectively provided at one end thereof with a first and second indoor heat exchangers 57 and 59 for mutually heat-exchanging the refrigerant with the room air through the media of refrigerant tubes 53 and 55.

Furthermore, the first and second indoor heat exchangers 57 and 59 are arranged at one end thereof with a second four-way valve 65 for controlling flow direction of the refrigerant gas through the media of refrigerant tubes 61 and 63, where, the second four-way valve 65 is connected to an infuse tube 67 for guiding the refrigerant gas to thereby be infused into the compressor 31.

The first and second four-way valves 35 and 65 are inter-connected therebetween through the medium of a direction change tube 69 so that the flow direction of the refrigerant can be controlled according to the cooling and heating operations of the air conditioner.

The refrigerant tube 39 and the infuse tube 67 are interconnected through the medium of a branch pipe 71, and the refrigerant 37 and the branch tube 71 are also interconnected through the medium of another branch pipe 73.

At this location, the branch tube 71 is disposed at a portion connecting with the refrigerant tube 39 with a solenoid valve 75 for stopping and releasing the flow of the refrigerant, and is simultaneously provided at a portion connecting with the infuse tube 67 with a check valve 77 for allowing the refrigerant to flow only toward the infuse tube 67.

Furthermore, the branch tube 73 is provided at a portion connection with the refrigerant tube 37 with a solenoid valve 79 in order to inhibit or release the flow of the refrigerant, and at a portion connecting with the first outdoor heat exchanger 4 with a solenoid valve 75 in order to control flow direction of the refrigerant.

In the aforementioned description, the first and second indoor heat exchangers 57 and 59 are included in an indoor unit according to the embodiment of the present invention.

Figure 6:
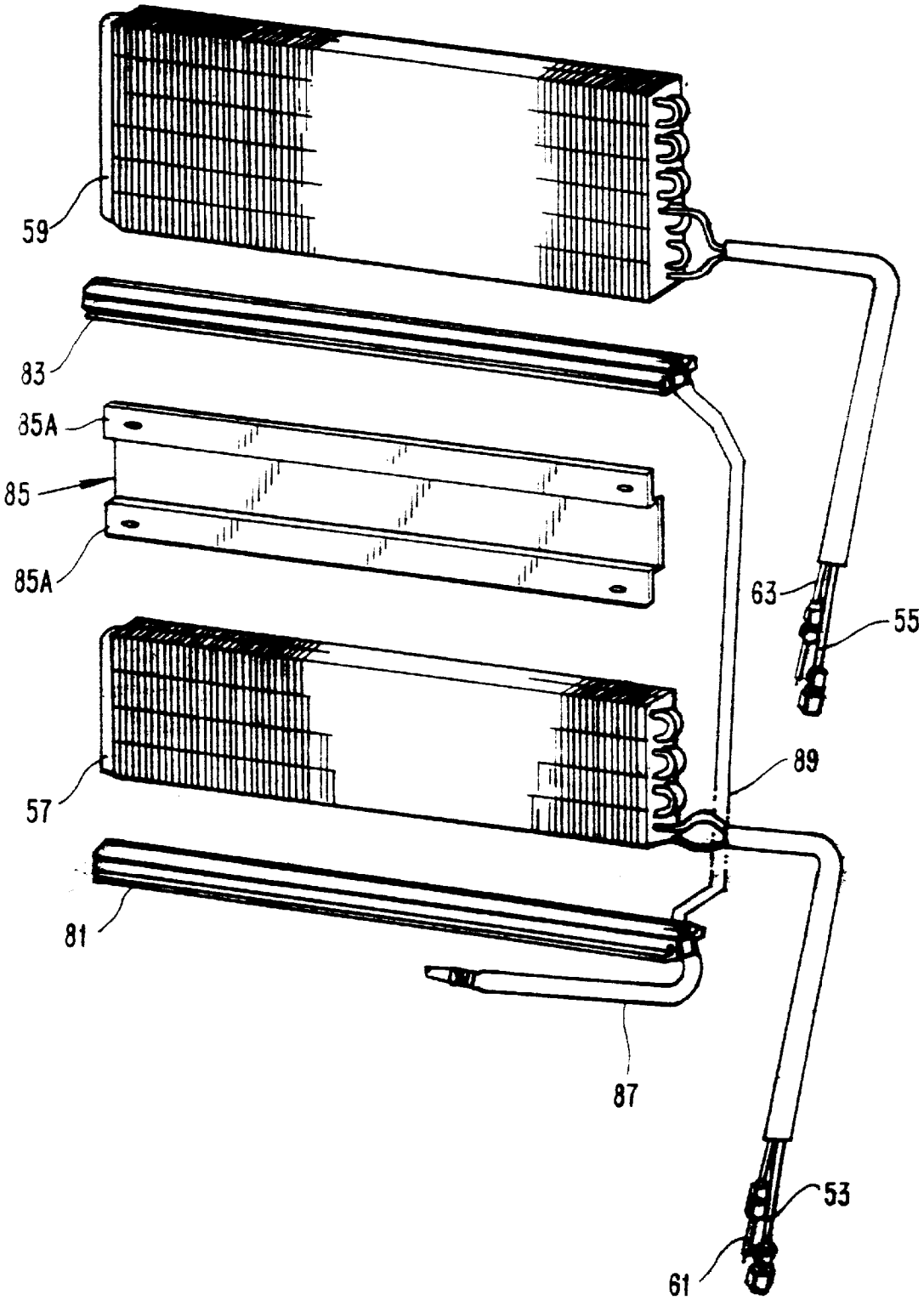
FIG. 6 is an exploded perspective view for illustrating principal portions of an indoor unit of an air conditioner according to the present invention.
Figure 7:
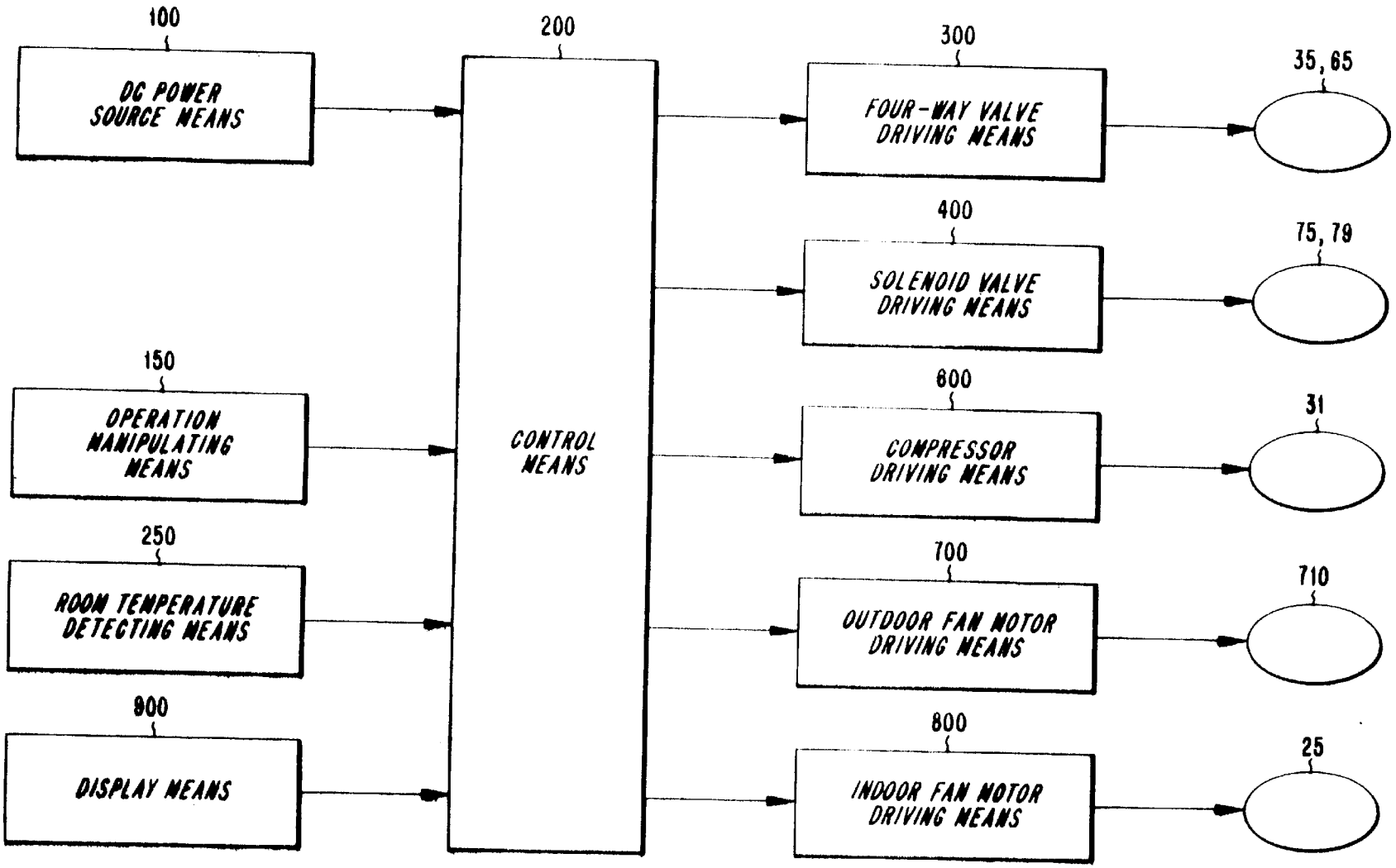
FIG. 7 is a block diagram of a control apparatus of an air conditioner according to the present invention.

As illustrated in FIGS. 6 and 7, the indoor unit of an air conditioner according to the embodiment of the present invention is respectively provided at upper and lower areas in a body 1 with the first and second indoor heat exchangers 57 and 59 for the refrigerant to flow therein so that the room air can be heat-exchanged.

The first and second indoor heat exchangers 57 and 59 are respectively arranged at respective lower sides thereof with a first and second water pads 81 and 83, so that the concentrated water can be stored that flows down according as the moisture contained in the room air contacts the first and second indoor heat exchangers 57 and 59 to thereafter be concentrated when the first and second indoor heat exchangers 57 and 59 function as evaporators.

The first second indoor heat exchangers 57 and 58 are disposed at a space formed therebetween with an air cut-off panel 85 such that the air sucked into the body 10 through the suction inlet 15 can be heat-exchanged by the first and second indoor heat exchangers 57 and 59 without being leaked out intact toward the indoor fan 25.

Furthermore, the first and second indoor heat exchangers 57 and 59 are respectively connected to the refrigerant tubes (53, 61) and refrigerant tubes (55, 63) such that the refrigerant is allowed to pass therethrough, as illustrated in FIG. 4.

The first and second water pads 81 and 83 are respectively connected at respective side surfaces thereof, as illustrated in FIG. 6, to first and second exit tubes 87 and 89 so that the concentrated water stored in the first and second water pads 81 and 83 can be guided and discharged outside.

Magnitude a ratio between the first indoor heat exchanger 57 and the second indoor heat exchanger 59, namely, a heat exchange area ratio, is approximately 4:6 and the air cut-off panel 85 has a " " shape in order to be easily installed at a space formed between the first indoor heat exchanger 57 and the second indoor heat exchanger 59.

As illustrated in FIG. 7, direct current DC power source means 100 serves to receive a commercial alternating current AC power source supplied from an AC power source input terminal (not shown) to convert the same to a predetermined DC voltage necessary for operation of the air conditioner and output the same.

Operation manipulating means 150 is disposed with a plurality of function keys so that operation functions of the air conditioner wanted by the user can be selected, where operation selections (simultaneous cooling, simultaneous heating, simultaneous cooling and heating, separate cooling, separate heating, dehumidifying, artificial intelligence, air-cleaning, advance operation, operation/stop, and the like), established temperature (Ts), time establishment, established wind amount and established wind direction are input thereinto.

Control means 200 is a micro computer which serves to receive a DC voltage output from the DC power source means 100 to initialize the air conditioner and to control overall air conditioning operations according to operation conditions, operation/stop signal input through the operation manipulating means 150.

Indoor temperature detecting means 250 serves to control the room temperature to cause the same to become a temperature establihed by the user via the operation manipulating means 150, and detect a temperature (Tr) of room air sucked through the suction inlet 5 of the air conditioner to thereby output the same to the control means 200.

Four-way valve driving means 300 serves to receive a control signal output from the control means 200 to activate and deactivate the four-way valves 35 and 65 so that a passage of the refrigerant circulating therein can be changed according to the operation conditioner (cooling or heating) input through the operation manipulating means 150.

Solenoid valve driving means 400 serves to receive the control signal output from the control means 200 to thereby activate and deactivate the solenoid valves 75 and 79 so that the passage where the refrigerant is circulated can be opened or closed according to the operation condition (cooling or heating) input through the operation manipulating means 150.

Furthermore, compressor driving means 600 serves to receive the control signal output from a control means 200 according to a difference between temperature (Ts) established by the user via the operation manipulating means 150 and the room temperature (Tr) detected by the indoor temperature detecting means 250, controllably driving the compressor 31.

Outdoor fan motor driving means 700 serves to receive the control signal of the control means 200 according to a difference between the temperature Ts established by the user through the operation manipulating means 150 and the room temperature Tr detected by the indoor temperature detecting means 250 to thereby blow outside the air heat-exchanged by the outdoor heat exchanger, so that revolution of the outdoor fan motor can be controlled to controllably drive the outdoor fan 710.

Indoor fan motor driving means 800 serves to receive a control signal of the control means 200 according to wind amount established by the user through the operation manipulating means 150 to thereby blow indoors the air (cool wind or warm wind) heat exchanged by the indoor heat exchangers 57 and 59 such that revolution of the indoor fan motor is controlled to controllably drive the indoor fan 810.

Display means 900 serves not only to display the operation condition established by the user through the operation manipulating means 150 but to display operation condition of the air conditioner.

Now, operation of the indoor unit of the air conditioner according to the embodiment of the present invention constructed as mentioned above, and effect thereof will be described in connection with a circulation operation of the refrigerant flowing in the outdoor unit.

Figure 8:
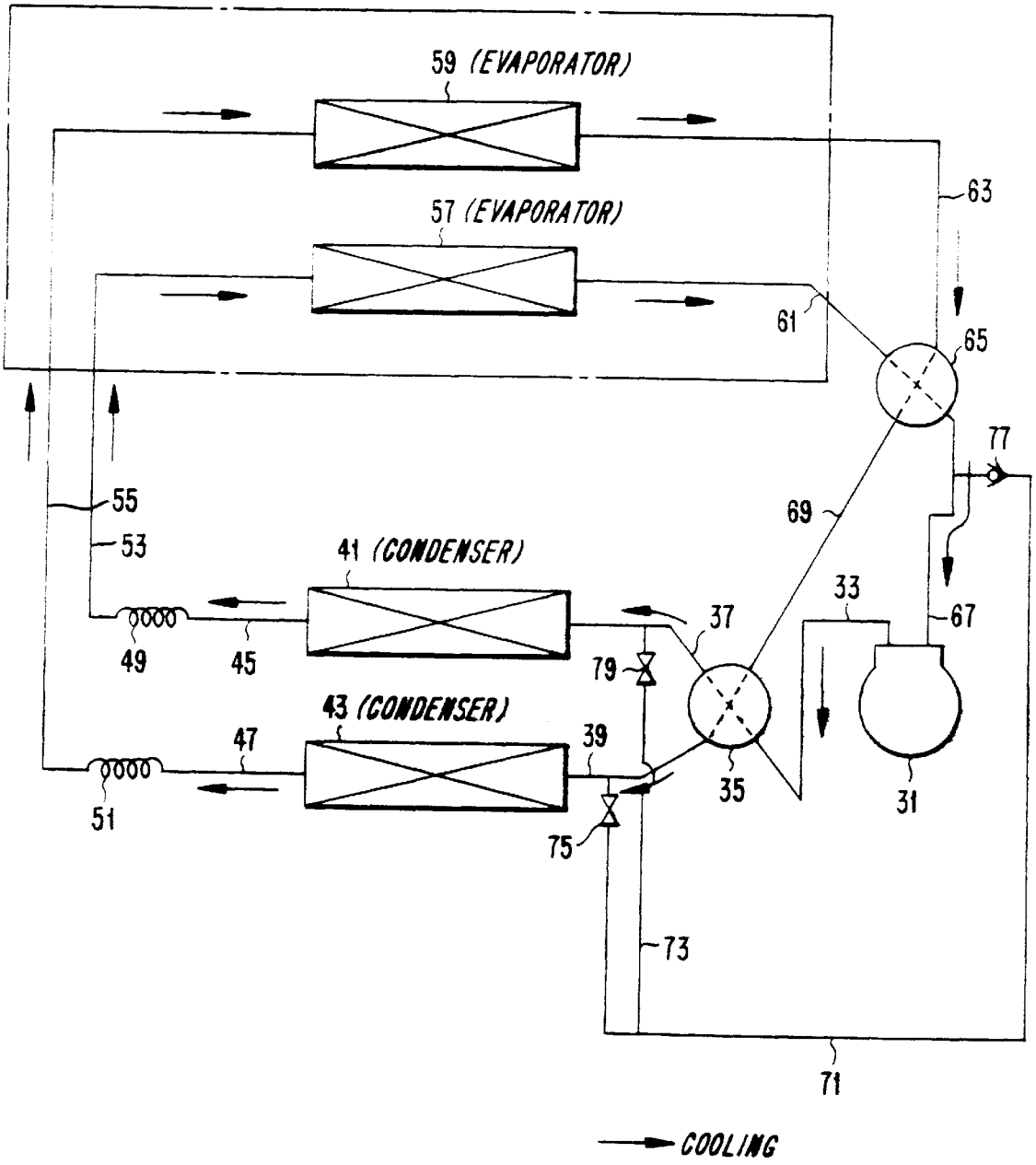
FIG. 8 through 15 are schematic diagrams for illustrating refrigerant cycle of an air conditioner according to the present invention.

First of all, with the first and second indoor heat exchangers 57 and 59 operating as evaporators, when the operation manipulating means 150 is manipulated to cool the room, the control means 200, as illustrated in FIG. 8, serves to input the control signal to the four-way valve driving means 300 and the solenoid valve driving means 400.

Accordingly, the discharge pipe 33 and the refrigerant tubes 37 and 39 are interconnected according to the control of the first four-way valve 35, and, at the same time, the infuse tube 67 and the refrigerant tubes 61 and 63 are also interconnected to thereby deactivate the solenoid valves 75 and 79.

Under this condition, the compressor is activated to compress the refrigerant in high temperature and to high temperature and to high pressure. Then, the refrigerant gas of high temperature and high pressure which has been dischasrged from the compressor 31 and infused into the discharge pipe 33 is introduced into the first and second outdoor heat exchanger 41 and 43 through the refrigerant tubes 37 and 39, cooly concentrated, heat-exchanged with outdoor air and thereafter liquefied.

The liquefied refrigerant of high pressure is then infused into the first and second capillary tubes 49 and 51 through the refrigerant tubes 45 and 47.

The refrigerant liquid of high pressure infused into the first and second capillary tubes 49 and 51 is changed into refrigerant of low pressure according to adiabatic expansion effect of the first and second capillary tubes 49 and 51, thereafter being infused into the first and second indoor heat exchangers 57 and 59 through the refrigerant tubes 53 and 55.

Successively, the refrigerant liquid of low pressure is evaporated in the first and second indoor heat exchangers 57 and 59, heat-exchanged with the room air and to cool the room.

At this time, the refrigerant liquid of lower pressure is transformed into refrigerant gas, which in turn passes the refrigerant tubes 61 and 63 and the infuse tube 67 sequentially to thereafter be infused into the compressor 31.

Then, the refrigerant gas is transformed into refrigerant gas of high pressure and high temperature and repeats flowing in the refrigerant cycle mentioned above.

As mentioned above, quick cooling is possible because the first and second indoor heat exchangers 57 and 59 simultaneously function as evaporators during the indoor cooling.

Furthermore, dehumidifying effect can be obtained because the moisture contained in the room air contacts the first and second indoor heat exchangers 57 and 59 functioning as evaporators to thereafter be concentrated.

Figure 9:
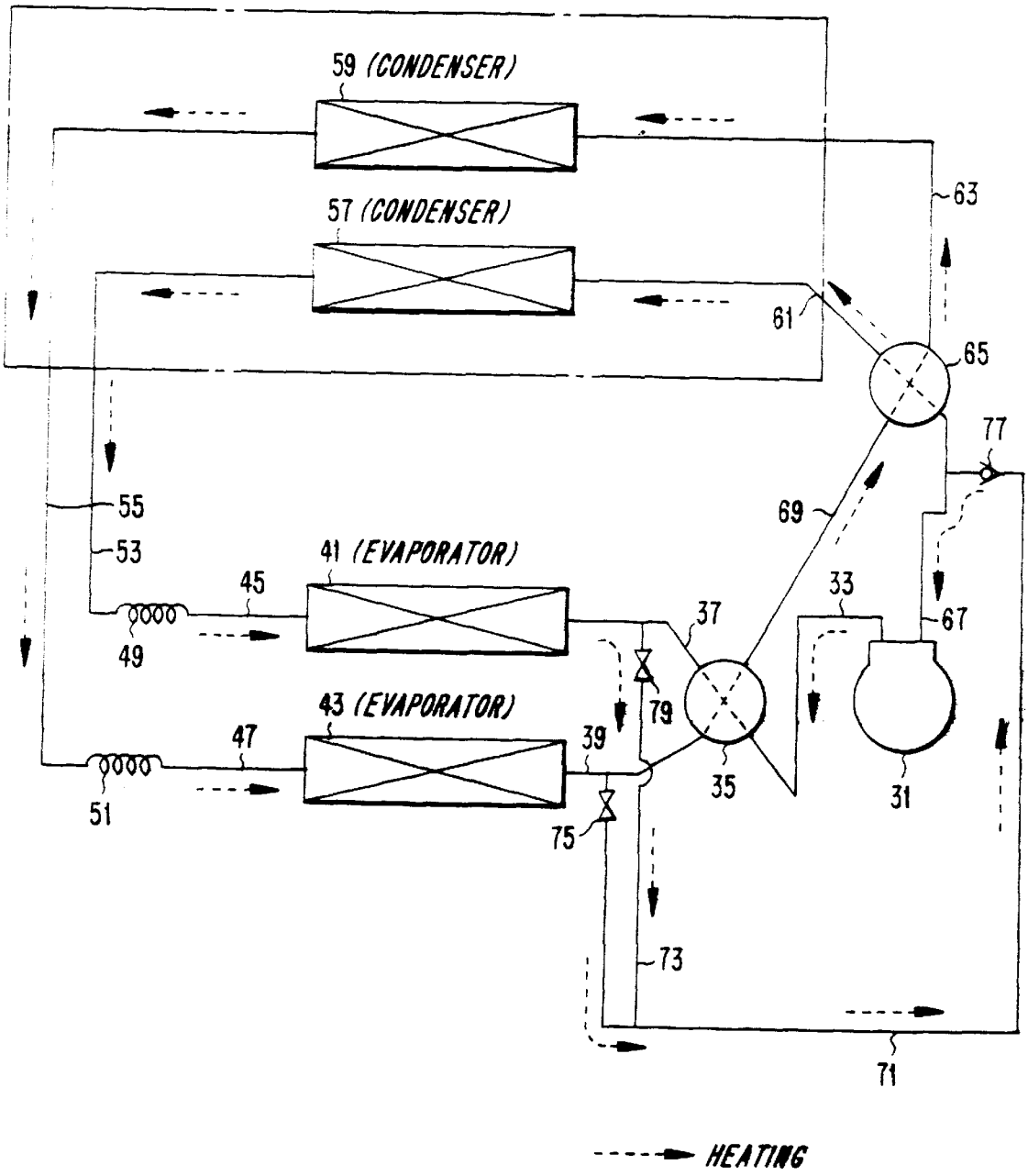

Next, when the operation manipulating means 150 is manipulated in order to cool the room with the first and second indoor heat exchangers 57 and 59 functioning as evaporators, the control signal of the control means 200 is input to the four-way valve driving means 300 and the solenoid valve driving means 400, as illustrated in FIG. 9.

Accordingly, the discharge pipe 33 and a direction change pipe 69 are interconnected by the control of the first four-way valve 35, and, at the same time, the direction change pipe 69 and the refrigerant tubes 61 and 63 are also interconnected by the control of the second four-way valve 65. Whereby the solenoid valves 75 and 79 are rendered activated.

Under this state, the compressor 31 is activated to compress the refrigerant to that of high temperature and high pressure, and the refrigerant gas of high temperature and high pressure discharged from the compressor 31 and infused into the discharge pipe 33 is infused into the first and second indoor heat exchangers 57 and 59 through the direction change pipe 69 and the refrigerant tubes 61 and 63 to thereafter be concentrated. The refrigerant gas is heat-exchanged with the room air to thereby heat the room.

At this time, the refrigerant gas is liquefied in high pressure, which, in turn is infused into the first and second capillary tubes 49 and 51 through the refrigerant tubes 53 and 55.

The refrigerant liquid of high pressure infused into the first and second capillary tubes 49 and 51 is transformed into refrigerant liquid of low pressure by the adiabatic expansion effect of the first and second capillary tubes 49 and 51 to thereafter be introducted into the first and second outdoor heat exchangers 41 and 43 through refrigerant tubes 45 and 47.

Accordingly, the refrigerant liquid of low pressure is evaporated in the first and second outdoor heat exchangers 41 and 43, heat-exchanged with the outdoor air and transformed into the refrigerant gas.

At this time, the refrigerant gas output from the first outdoor heat exchanger 41 passes the refrigerant tube 37, solenoid 79, branch pipe 73, another branch pipe 71, check valve 77 and infuse tube 67 in that order, to thereby be introduced into the compressor 31.

Furthermore, the refrigerant gas generated from the second outdoor heat exchanger 43 passes the refrigerant tube 39, solenoid valve 75, branch pipe 71, check valve 77 and the infuse tube 67 sequentially to thereafter be infused into the compressor 31.

The refrigerant gas is transformed into that of high pressure and high temperature by the compressor 31 to thereby repeat the refrigerant cycle mentioned above.

As mentioned above, quick heating is possible because the first and second indoor heat exchangers 57 and 59 are rendered to function as concentrators during the room heating.

Figure 10:
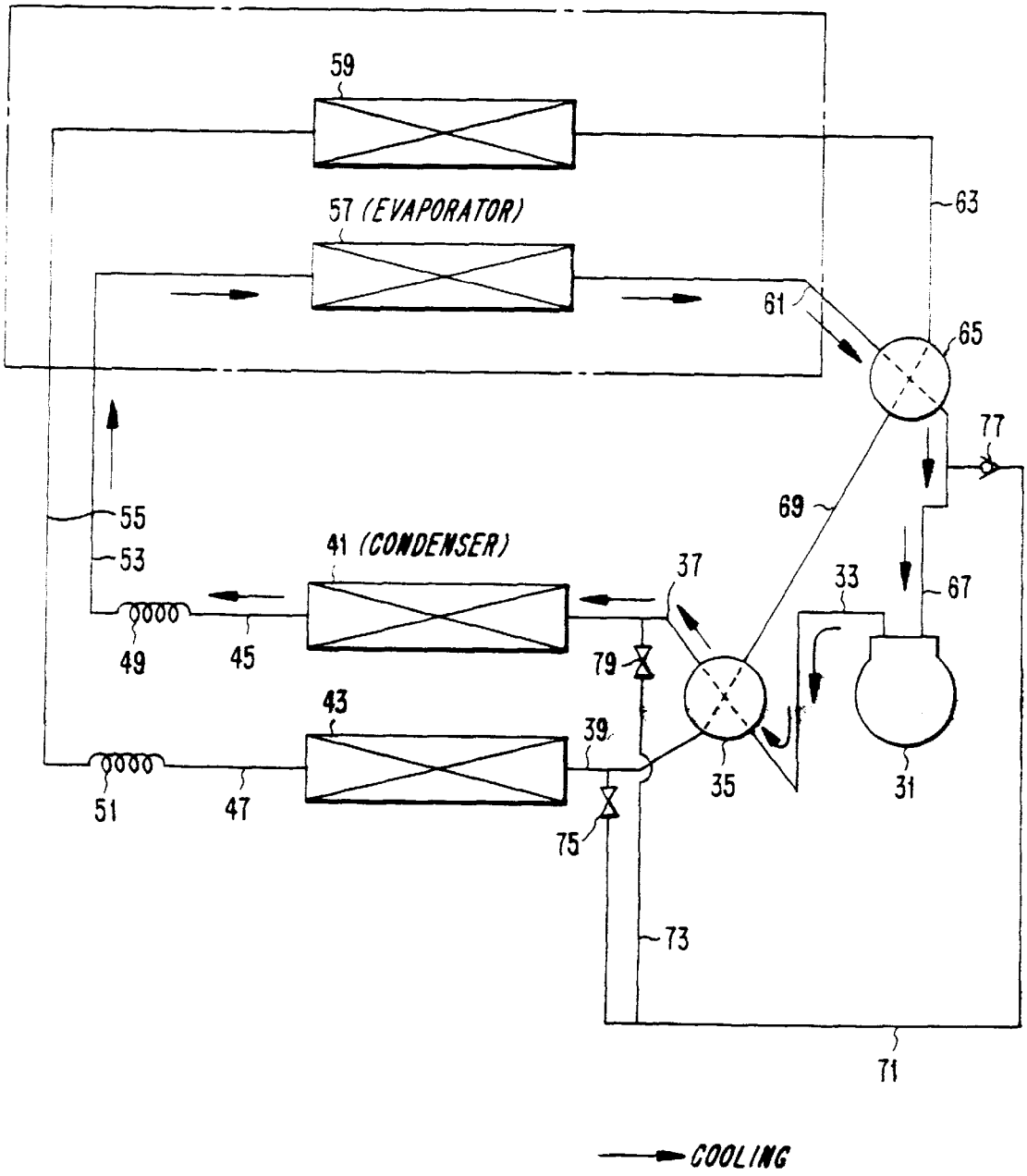

Next, when the operation manipulating means 150 is manipulated to cause only the first indoor heat exchanger 57 and function as an evaporator for room heating, the control signal of the control means 200 is input respectively to the four-way valve driving means 300 and the solenoid valve driving means 400, as illustrated in FIG. 10.

As a result, the discharge pipe 33 and the refrigerant tube 37 are interconnected by the control of the first four-way valve 35, and at the same time, the infuse tube 67 and the refrigerant tube are rendered interconnected by the control of the second four-way 65, whereby the solenoid is rendered inoperative.

Under this state, the compressor 31 is activated to thereby compress the refrigerant to that of high pressure and high temperature, and the refrigerant of high pressure and high temperature discharged from the compressor 31 and infused into the discharge pipe 33 is introduced into the first outdoor heat exchanger 41 through the refrigerant tube 37, cooly concentrated, heat-exchanged with the outdoor air and liquefied in high pressure.

The liquefied high-pressurized refrigerant is then infused into the first capillary tube 49 through the refrigerant tube 45.

Thereafter, the liquefid refrigerant of high pressure is transformed into that of low pressure by the adiabatic expansion effect of the first capillary tube 49, and infused into the first indoor heat exchanger 57 through the refrigerant tube 53.

As a result, the low-pressurized liquefied refrigerant is evaporated in the first indoor heat exchanger 57 and heat-exchanged with the room air to thereby cool the room.

At this time, the low-pressurized liquefied refrigerant is changed into refrigerant gas to thereby pass the refrigerant tube 61 and the infuse pipe 67 sequentially and be infused into the compressor 31.

Then, the low-pressurized liquefied refrigerant is transformed into refrigerant gas of high pressure and high temperature and repeats the refrigerant cycle mentioned above.

Figure 11:
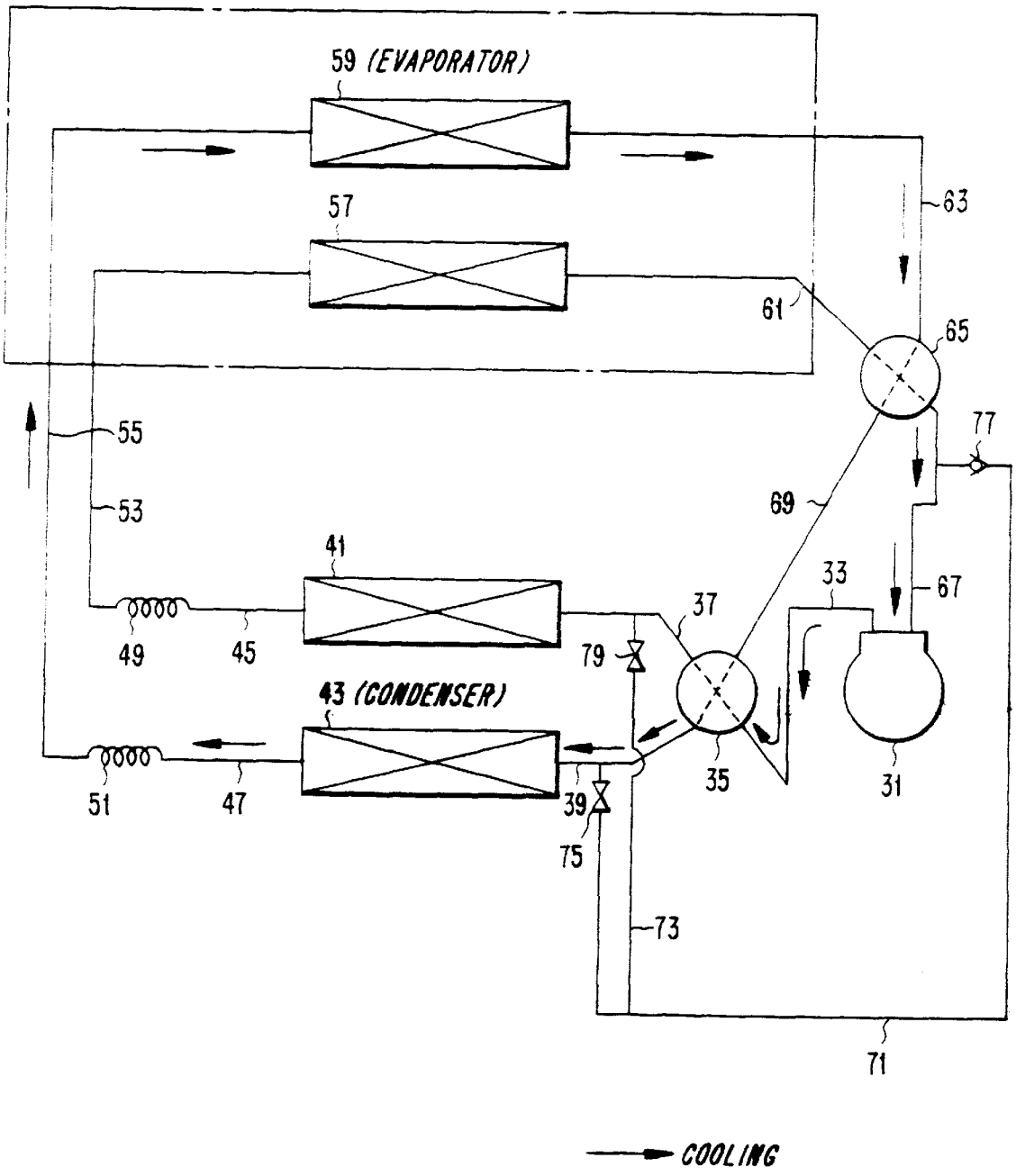

Meanwhile, when the operation manipulating means 150 is manipulated in order to cool the room with only the second indoor heat exchanger 59 functioning as evaporator, the control signal output from the control means 200 is input to the four-way valve driving means 300 and the solenoid valve driving means 400 as illustrated in FIG. 11.

As a result, the discharge pipe 33 and the refrigerant tube 39 are rendered interconnected by the control of the first four-way valve 35, and, at the same time, the infuse tube 67 and the refrigerant tube 63 are also render interconnected by the control of the second four-way valve 65, whereby the solenoid valve 75 is rendered inactivated.

Under this state, the compressor 31 is activated to thereby compress the refrigerant to that of high pressure and high temperature, and the refrigerant of high pressure and high temperature that has been discharged from the compressor 31 and infused into the discharge pipe 33 is caused to flow into the second outdoor heat exchanger 43 through the refrigerant tube 39, and is cooly concentrated and heat-exchanged with the outdoor air to thereafter be liquefied in high pressure.

The liquefied high-pressurized refrigerant is in turn infused into the second capillary tube 51 through the refrigerant tube 47.

As a result, the high-pressurized liquefied refrigerant is transformed into that of low pressure by the adiabatic expansion effect of the second capillary tube 51 to thereafter be introduced into the second indoor heat exchanger 59 through the refrigerant tube 55.

The liquefied refrigerant of low pressure is evaporated in the second indoor heat exchanger 59 to thereafter be heat-exchanged with the room air so that the room is cooled.

At this time, the liquefied refrigerant of low pressure is transformed into the refrigerant gas which in turn passes the refrigerant tube 63 and the infuse tube 67 sequentially to thereafter be infused into the compressor 31.

Then, the refrigerant gas is transformed into that of high pressure and high temperature to thereby repeat the refrigerant cycle mentioned above.

As mentioned above, there is an advantage in that unnecessary consumption of electric power can be avoided because an indoor cooling is performed by operation of one evaporator out of the first and second indoor heat exchangers 57 and 59 having mutually different heat transmission areas.

Furthermore, there is another advantage in that the moisture contained in the room air can be concentrated to thereby control a cooling temperature and a room humidity.

Figure 12:
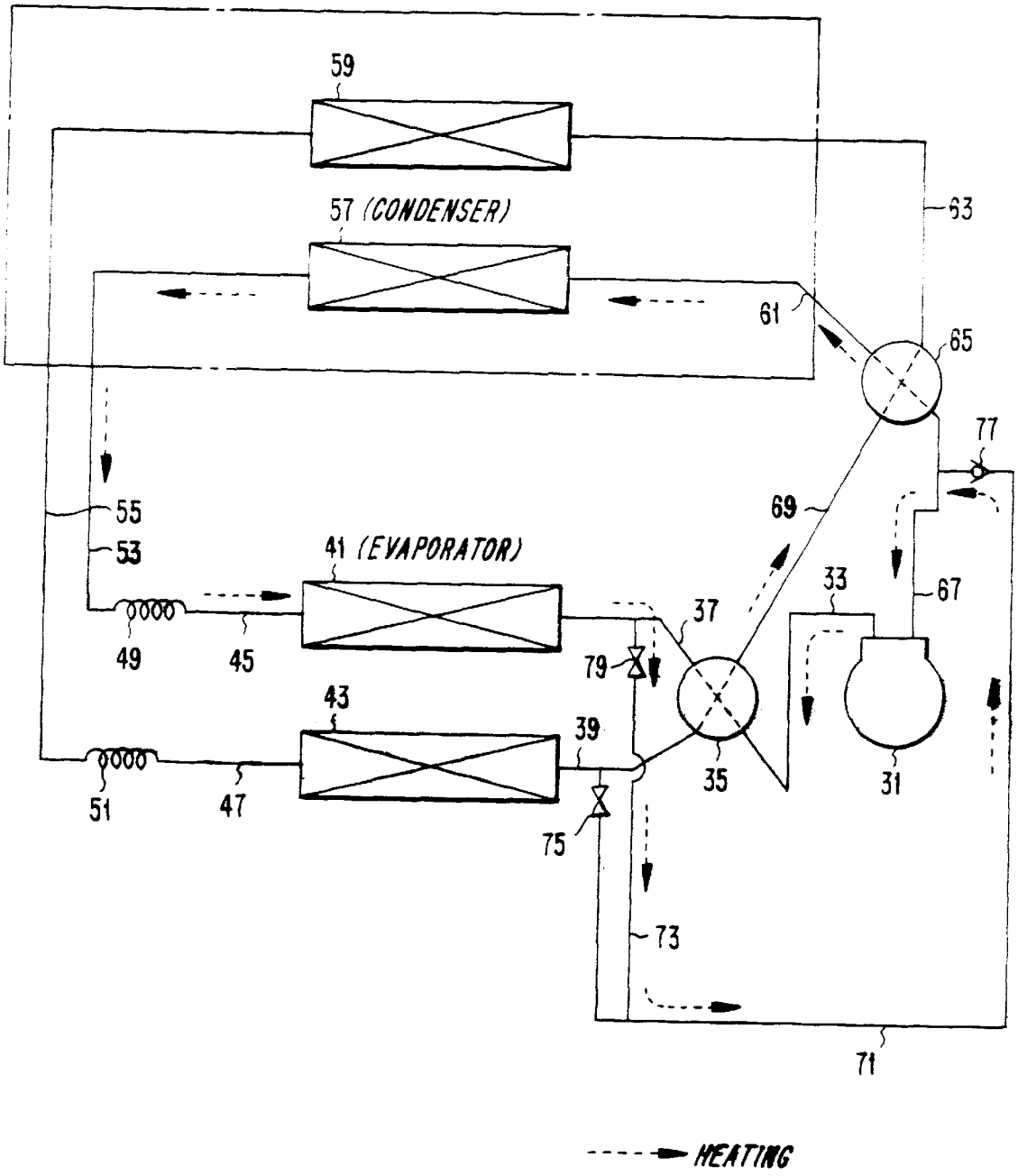

Next, when the operation manipulating means 150 is manipulated to cool the room with only the first indoor heat exchanger 57 operating as an evaporator, the control signal output from the control means 200 is input to the four-way valve driving means 300 and the solenoid valve driving means 400, as shown in FIG. 12.

As a result, the discharge pipe 33 and the direction change tube 69 are rendered interconnected according to the control of the fist four-way valve 35, and, simultaneously, the direction change tube 69 and the refrigerant tube 61 are also rendered interconnected according to the control of the second four-way valve 65, whereas the solenoid valve 75 is rendered inactive and another solenoid valve 79 is rendered active.

Under this state, the compressor 31 is rendered active to thereby compress the refrigerant in high temperature and high pressure, and the refrigerant gas of high pressure and high temperature infused from the compressor 31 to the discharge pipe 33 passes the direction change tube 69 and the refrigerant tube 61 sequentially and is infused into the first indoor heat exchanger 57.

The refrigerant gas of high pressure and high temperature is then heat-exchanged with the room air to thereby perform the heating of the room.

At this time, the refrigerant gas is liquefied in high pressure, which is in turn infused into the first capillary tube 49.

The refrigerant liquid of high pressure infused into the first capillary tube 49 is transformed into that of low pressure by way of the adiabatic expansion effect of the first capillary tube 49 and infused into the first outdoor heat exchanger 41 through the refrigerant tube 45.

As a result, the liquefied refrigerant of low pressure is evaporated in the first outdoor heat exchanger 41, heat-exchanged with the outdoor air and transformed into refrigerant gas, and then passes the solenoid valve 79, branch pipe 73, another branch pipe 71, check valve 77 and the infuse tube 67 in that order, to thereafter be infused into the compressor 31.

Then, the refrigerant gas is transformed into that of high pressure and high temperature by the compressor 31 and repeats the refrigerant cycle mentioned above.

Figure 13:
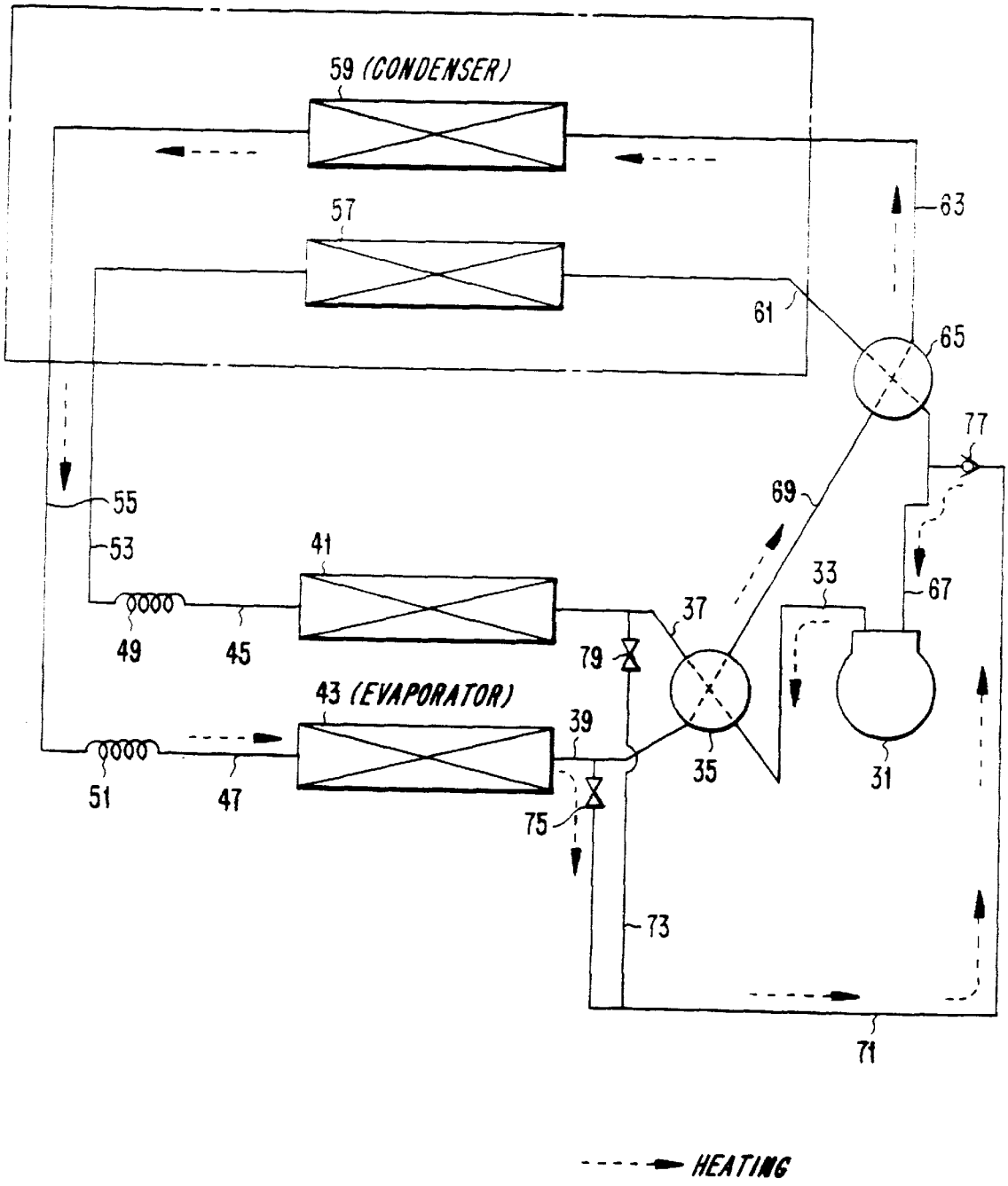

Meanwhile, when the operation manipulating means 150 is manipulated to heat the room by operating only the second indoor heat exchanger 59 to function as a concentrator, the control signal output from the control means 200 is input to the four-way valve driving means 300 and the solenoid valve driving means 400, as illustrated in FIG. 13.

Successively, the discharge pipe 33 and the direction charge tube 69 are interconnected according to the control of the first four-way valve 35, and, at the same time, the direction change tube 69 and the refrigerant tube 63 are also interconnected by the control of the second four-way valve 65, where, the solenoid valve 75 is rendered activated but the other solenoid valve 79 is rendered inactivated.

Under this state, the compressor 31 is operated to thereby compress the refrigerant in high pressure and high temperature, and the refrigerant of high pressure and high temperature infused from the compressor 31 into the discharge pipe 33 passes the direction change tube 69 and the refrigerant tube 63 requentially to thereafter be introduced into the second indoor heat exchanger 59. Then it is heat-exchanged with the room air to thereby heat the room.

At this time, the refrigerant gas is liquefied in high pressure, which is in turn infused into the second capillary tube 51 through the refrigerant tube 55.

The high-pressurized refrigerant liquid that has been infused into the second capillary tube 51 is transformed into liquefied refrigerant of low pressure by the adiabatic expansion effect of the second capillary tube 51, which is infused into the second outdoor heat exchanger 43 through the refrigerant tube 47.

As a result, the liquefied refrigerant of low pressure is evaporated in the second outdoor heat exchanger 43, heat-exchanged with the outdoor air and is transformed into the refrigerant gas.

The refrigerant gas now passes the refrigerant tube 39, solenoid valve 75, branch tube 71, check valve 77 and the infuse tube 67 in that order, to thereafter be introduced into the compressor 31.

Thereafter, the refrigerant gas is transformed into refrigerant gas of high pressure and high temperature by the compressor 31 and repeats the refrigerant cycle mentioned above.

As mentioned above, there is an advantage in that unnecessary consumption of electric power can be reduced, and, at the same time, fine control of heating temperature can be possible because the room is heated by operation of only one indoor heat exchanger as an evaporator out of the first and second indoor heat exchangers having mutually different heat transmission areas.

Next, when the operation manipulating means 150 is so manipulated as to heat the room and at the same time to remove the humidity contained in the room air by operation of the first indoor heat exchanger 57 as an evaporator and by operation of the second indoor heat exchanger 59 as a concentrator, the control signal output from the control means 200 is input to the four-way valve driving means 300 and the solenoid valve driving means 400, as shown in FIG. 12.

As a result, the discharge pipe 33 and the refrigerant tube 37 are interconnected by the control of the first four-way valve 35, and, at the same time, the infuse tube 67 and the refrigerant tube 61 are also interconnected by the control of the second four-way valve 65, where the solenoid valve 79 is rendered inactive.

On the other hand, the discharge pipe 33 and the direction change pipe 69 are interconnected by the control of the first four-way valve 35 and simultaneously the direction change pipe 69 and the refrigerant tube 63 are interconnected by the control of the second four-way valve, whereby the solenoid valve 75 is rendered active.

Under this state, the compress 31 is operated to thereby cause the refrigerant to circulate as illustrated in FIGS. 10, 11, 12 and 13, so that the room can be dehumidified by the first indoor heat exchanger 57 and simultaneously the room can be heated by the second indoor heat exchanger 59.

Figure 15:
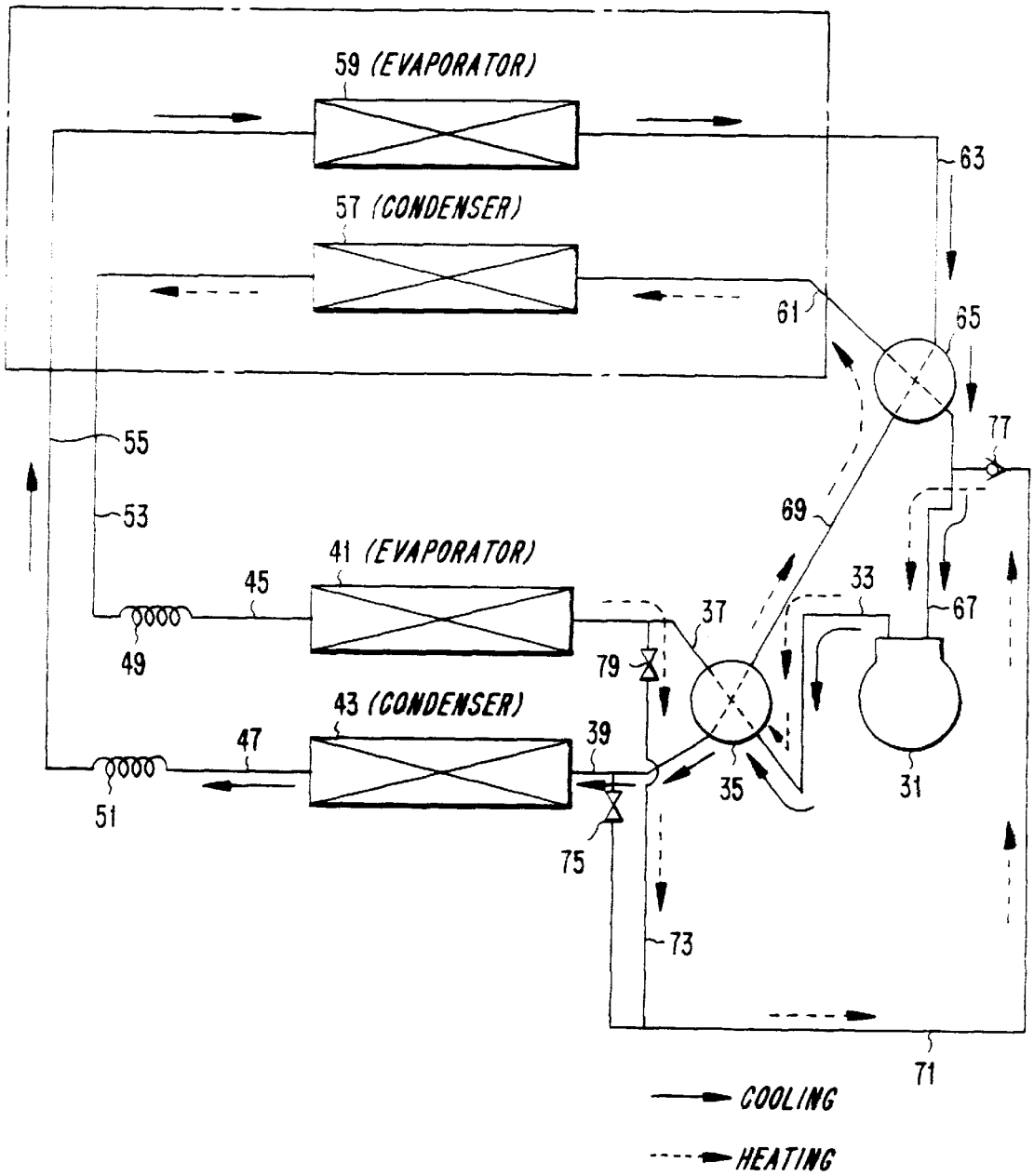

Now, when the operation manipulating means 150 is operated such that the first indoor heat exchanger 57 serves to function as a concentrator and the second indoor heat exchanger 59 serves to function as an evaporator to thereby heat the room and simultaneously to remove the humidity contained in the room air, the control signal output from the control means 200 is infused into the four-way valve driving means 300 and the solenoid valve driving means 400, as illustrated in FIG. 15.

As a result, the discharge pipe 33 and the direction change pipe 69 are interconnected by the control of the first four-way valve 35 and the direction change pipe 69 and the refrigerant tube 61 are interconnected by the control of the second four-way valve 65, while the solenoid valve 79 is rendered active.

Meanwhile, the discharge pipe 33 and the refrigerant tube 39 are interconnected by the control of the first four-way valve 35 and the infuse tube 67 and the refrigerant tube 63 are also interconnected by the control of the second four-way valve 65, whereas the solenoid valve 75 is rendered inactive.

Under this state, the compressor 31 is operated to thereby cause the refrigerant to circulate as illustrated in FIGS. 12 and 11, so that the room is heated by the first indoor heat exchanger 57 and simultaneously the room is dehumidified by the second indoor heat exchanger 59.

Figure 14:
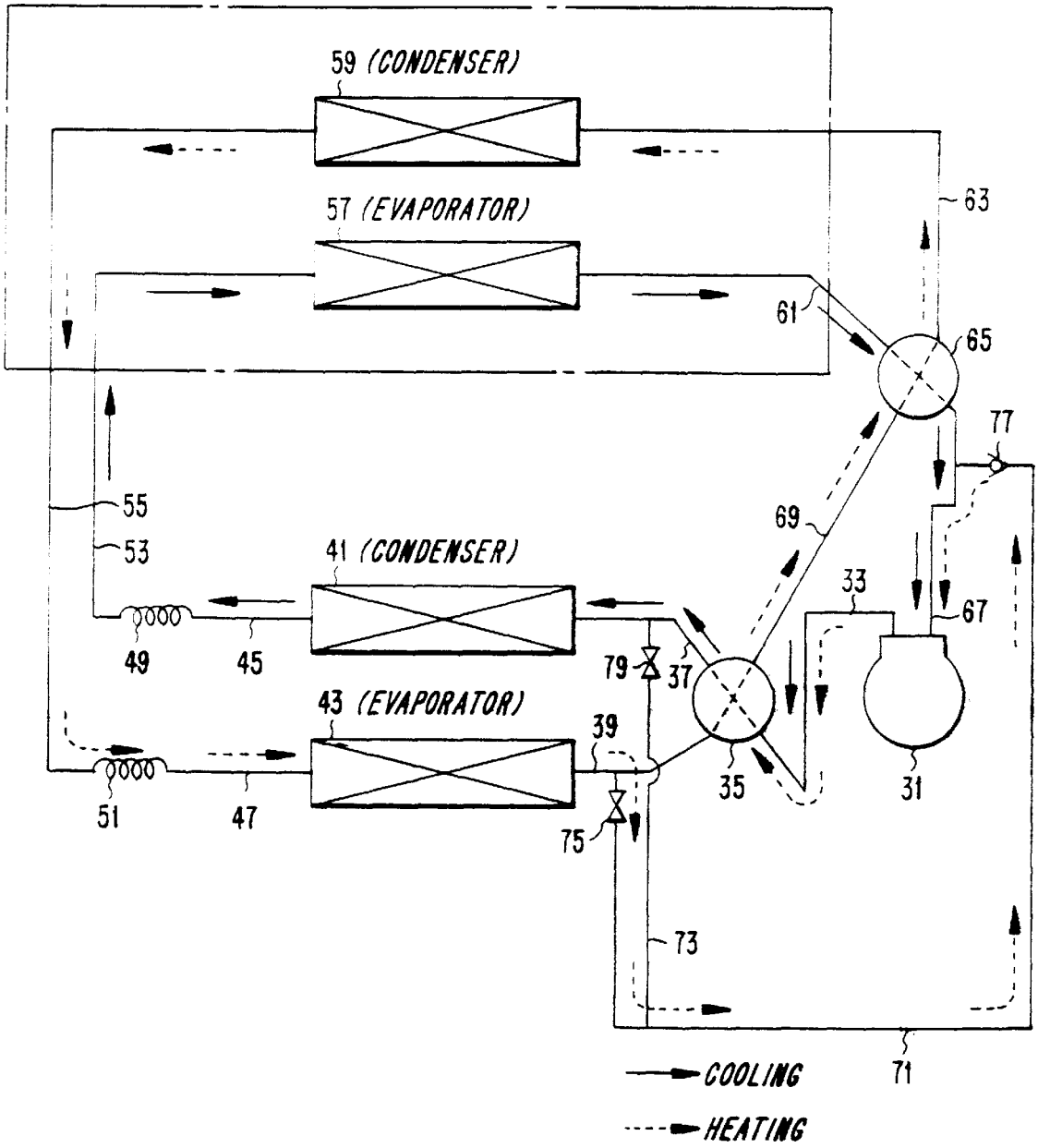

Accordingly, when an air conditioner is operated according to the refrigerant cycle illustrated in FIGS. 14 and 15, there is an advantage in that the heating and dehumidification can be performed simultaneously by way of fine control of the cooling temperature and room temperature according to the first and second indoor heat exchangers 57 and 59 having mutually different heat transmission areas.

On the other hand, as illustrated in FIG. 6, when the first indoor heat exchanger 57 or the second indoor heat exchanger 59 is operated to function as an evaporator, the moisture included in the room air contacts the first indoor heat exchanger 57 or the second indoor heat exchanger 59 to thereby be concentrated.

At this time, the concentrated water is stored in the first water pad 81 or the second water pad 83 to thereafter be drained outside through the first or the second exit tubes 87 and 89.

As apparent from the foregoing, there is an advantage in the air conditioner mentioned above in that one indoor unit is connected to two indoor heat exchangers, where the two indoor heat exchangers can be operated simultaneously or separately for fine control of the temperature and the humidity.

There is another advantage in that, although unexplained in the detailed description of the invention, two rooms can be simultaneously or reparately cooled or heated according to the operation conditioner established by the user.

Having described specific preferred embodiment of the invention with reference to the accompanying drawings, it is to be understood that the invention is not limited to those precise embodiments, and that various changes and modifications may be effected therein by one skilled in the art without departing from the scope or spirit of the invention as defined in the appended.

What is claimed is:

1. An air conditioning system for heating and cooling, comprising:

an outdoor heat exchange mechanism;

an indoor heat exchange unit including a housing and two separate indoor heat exchangers connected by refrigerant piping to the outdoor heat exchange mechanism;

a compressor connected by refrigerant conduits to the outdoor heat exchange mechanism and the indoor heat exchangers;

a manually manipulable member for setting a desired operating condition; and an electric valve arrangement operably connected to the manual manipulable member and to the refrigerant conduits for operating: one or both of the indoor heat exchangers as evaporators during a cooling operation, one or both of the indoor heat exchangers as condensers during a heating operation, and one of the indoor heat exchangers as an evaporator and simultaneously the other of the indoor heat exchangers as a condenser during a heating/dehumidifying operation;

wherein the outdoor heat exchange mechanism comprises a pair of outdoor heat exchangers connected to respective ones of the indoor heat exchangers.

2. The air conditioning system according to claim 1 wherein the valve arrangement comprises a first four-way valve connected between the indoor heat exchangers and the compressor, and a second four-way valve connected between the outdoor heat exchangers and the compressor.

3. The air conditioning system according to claim 2, further including first and second refrigerant tubes each having one end connected to the compressor, and another end connected to a respective refrigerant conduit at a location between the second four-way valve and a respective outdoor heat exchanger, and solenoid valves for opening and closing respective ones of the refrigerant tubes.

4. An air conditioning system for heating and cooling, comprising:

an outdoor heat exchange mechanism;

an indoor heat exchange unit including a housing and two separate indoor heat exchangers connected by refrigerant piping to the outdoor heat exchange mechanism, the housing of the indoor heat exchange unit forming an interior chamber and including an inlet leading to the chamber, and an outlet leading from the chamber, the indoor heat exchange unit further including a fan in the housing for circulating air through the chamber from the inlet to the outlet;

a compressor connected by refrigerant conduits to the outdoor heat exchange mechanism and the indoor heat exchangers;

a manually manipulable member for setting a desired operating condition;

an electric valve arrangement operably connected to the manual manipulable member and to the refrigerant conduits for operating: one or both of the indoor heat exchangers as evaporators during a cooling operation, one or both of the indoor heat exchangers as condensers during a heating operation, and one of the indoor heat exchangers as an evaporator and simultaneously the other of the indoor heat exchangers as a condenser during a heating/dehumidifying operation; and a panel covering a space formed between the two indoor heat exchangers to prevent a leakage of air between the two indoor heat exchangers.

5. The indoor heat exchange unit according to claim 4 wherein the two indoor heat exchangers are vertically spaced apart.

6. An air conditioning system for heating and cooling, comprising:

an outdoor heat exchange mechanism;

an indoor heat exchange unit including a housing and two separate indoor heat exchangers connected by refrigerant piping to the outdoor heat exchange mechanism, the housing of the indoor heat exchange unit forming an interior chamber and including an inlet leading to the chamber, and an outlet leading from the chamber, the indoor heat exchange unit further including a fan in the housing for circulating air through the chamber from the inlet to the outlet;

a compressor connected by refrigerant conduits to the outdoor heat exchange mechanism and the indoor heat exchangers;

a manually manipulable member for setting a desired operating condition;

an electric valve arrangement operably connected to the manual manipulable member and to the refrigerant conduits for operating: one or both of the indoor heat exchangers as evaporators during a cooling operation, one or both of the indoor heat exchangers as condensers during a heating operation, and one of the indoor heat exchangers as an evaporator and simultaneously the other of the indoor heat exchangers as a condenser during a heating/dehumidifying operation; and two water collecting pans for collecting condensed water falling from respective ones of the indoor heat exchangers.

7. The indoor heat exchange unit according to claim 6 further including exit tubes connected to respective ones of the pans for draining water therefrom.

8. An air conditioning system for heating and cooling, comprising:

an outdoor heat exchange mechanism;

an indoor heat exchange unit including a housing and two separate indoor heat exchangers having different heat transmission areas and connected by refrigerant piping to the outdoor heat exchange mechanism;

a compressor connected by refrigerant conduits to the outdoor heat exchange mechanism and the indoor heat exchangers;

a manually manipulable member for setting a desired operating condition; and an electric valve arrangement operably connected to the manual manipulable member and to the refrigerant conduits for operating: either or both of the indoor heat exchangers as evaporators during a cooling operation, either or both of the indoor heat exchangers as condensers during a heating operation, either one of the indoor heat exchangers as an evaporator and simultaneously the other of the indoor heat exchangers as a condenser during a heating/dehumidifying operation.

9. The air conditioning system according to claim 8 wherein the outdoor heat exchange mechanism comprises a pair of outdoor heat exchangers connected to respective ones of the indoor heat exchangers.

10. The air conditioning system according to claim 8 wherein the housing of the indoor heat exchange unit forms an interior chamber and includes an inlet leading to the chamber, and an outlet leading from the chamber; the indoor heat exchange unit further including a fan in the housing for circulating air through the chamber from the inlet to the outlet.

11. The indoor heat exchange unit according to claim 10 wherein the two indoor heat exchangers have different respective heat transmission areas.

12. The indoor heat exchange unit according to claim 10 further including a panel covering a space formed between the two indoor heat exchangers to prevent a leakage of air between the two indoor heat exchangers.

13. The indoor heat exchange unit according to claim 10 further including two water collecting pans for collecting condensed water falling from respective ones of the indoor heat exchangers.

* * * * *